US008806789B2

(12) United States Patent
Devine

(10) Patent No.: US 8,806,789 B2
(45) Date of Patent: Aug. 19, 2014

(54) MULTI-CALIBER INTERCHANGEABLE RIFLE BOLT SYSTEM

(76) Inventor: Benjamin Cory Devine, Hillsboro, OH (US)

( * ) Notice: Subject to any disclaimer, the term of this patent is extended or adjusted under 35 U.S.C. 154(b) by 80 days.

(21) Appl. No.: 13/312,738

(22) Filed: Dec. 6, 2011

(65) Prior Publication Data

US 2013/0139424 A1 Jun. 6, 2013

(51) Int. Cl.

| | |
|---|---|
| ***F41A 3/12*** | (2006.01) |
| ***F41A 21/00*** | (2006.01) |
| ***F41A 3/26*** | (2006.01) |
| ***F41A 11/00*** | (2006.01) |
| ***F41A 3/66*** | (2006.01) |

(52) U.S. Cl.
CPC . *F41A 3/26* (2013.01); *F41A 11/00* (2013.01); *F41A 3/66* (2013.01)
USPC ..... 42/16; 42/75.02

(58) Field of Classification Search
CPC ..... F41A 3/26; F41A 11/00; F41A 3/66
USPC ..... 42/16, 75.02
See application file for complete search history.

(56) References Cited

U.S. PATENT DOCUMENTS

| | | | | |
|---|---|---|---|---|
| 5,900,577 | A * | 5/1999 | Robinson et al. | 89/191.01 |
| 7,596,900 | B2 * | 10/2009 | Robinson et al. | 42/7 |
| 7,971,379 | B2 * | 7/2011 | Robinson et al. | 42/7 |
| 7,971,382 | B2 * | 7/2011 | Robinson et al. | 42/75.02 |
| 7,975,595 | B2 * | 7/2011 | Robinson et al. | 89/185 |
| 8,096,074 | B2 * | 1/2012 | Robinson et al. | 42/16 |
| 8,522,465 | B2 * | 9/2013 | Jarboe et al. | 42/16 |
| 2006/0162217 | A1 * | 7/2006 | Longueira | 42/16 |
| 2009/0000173 | A1 * | 1/2009 | Robinson et al. | 42/75.02 |
| 2009/0031605 | A1 * | 2/2009 | Robinson | 42/2 |
| 2013/0326924 | A1 * | 12/2013 | Jarboe et al. | 42/17 |

* cited by examiner

*Primary Examiner* — Michael David

(57) ABSTRACT

An automatic machine gun capable of being quickly reconfigured to fire different calibers of ammunition. The elements necessary to reconfigure the weapon are all stored and contained within the stock of the weapon. The reconfiguration process does not require any external tools.

3 Claims, 7 Drawing Sheets

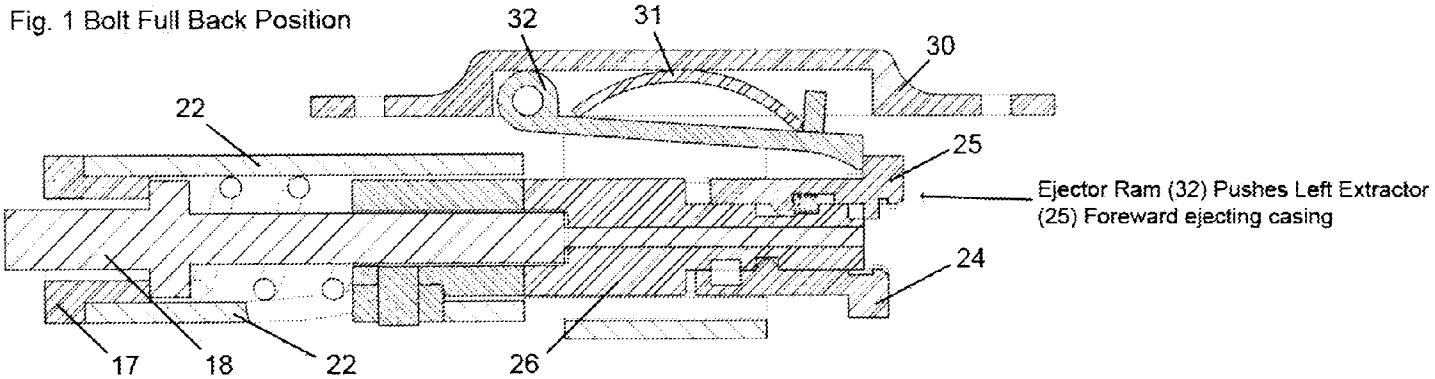
Fig. 1 Bolt Full Back Position
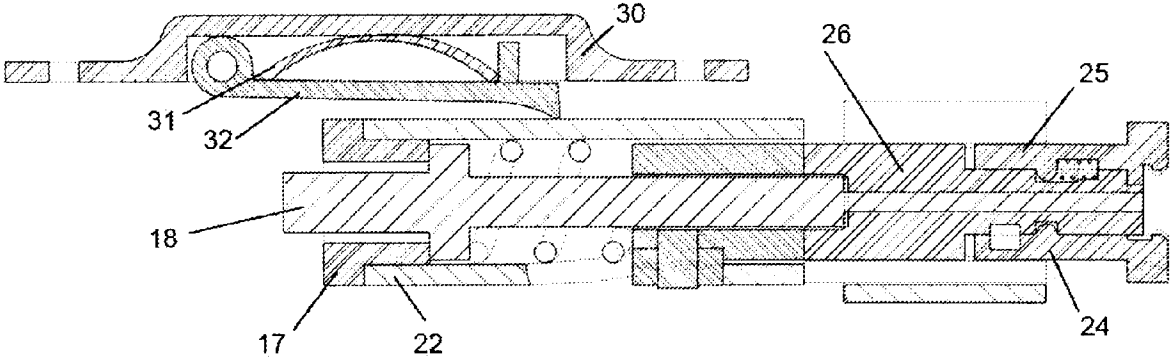
Fig. 2 Bolt Full Forward Position Fig. 3 Prior Art
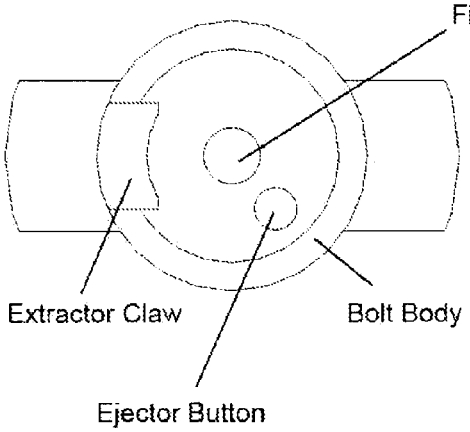
Fig. 4 Double Extractor Claw
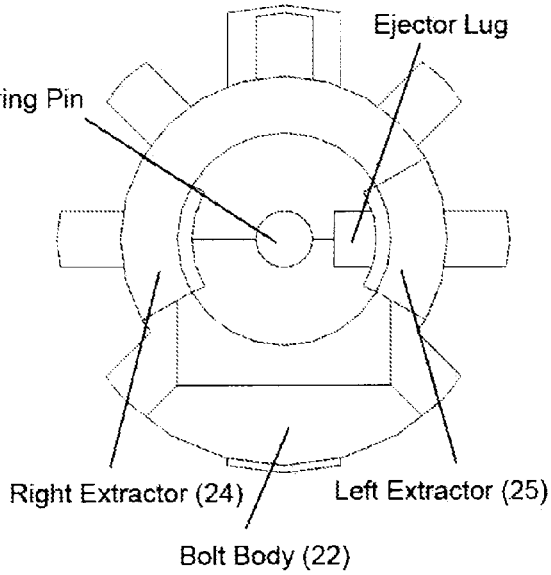

Fig. 5 Operational Position
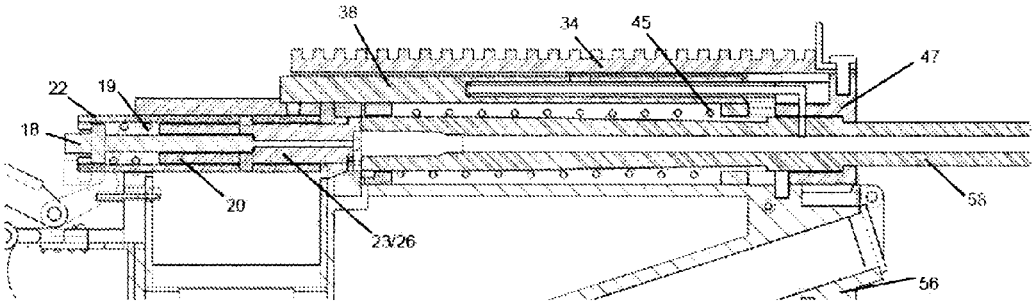
Fig. 6 Opened Position
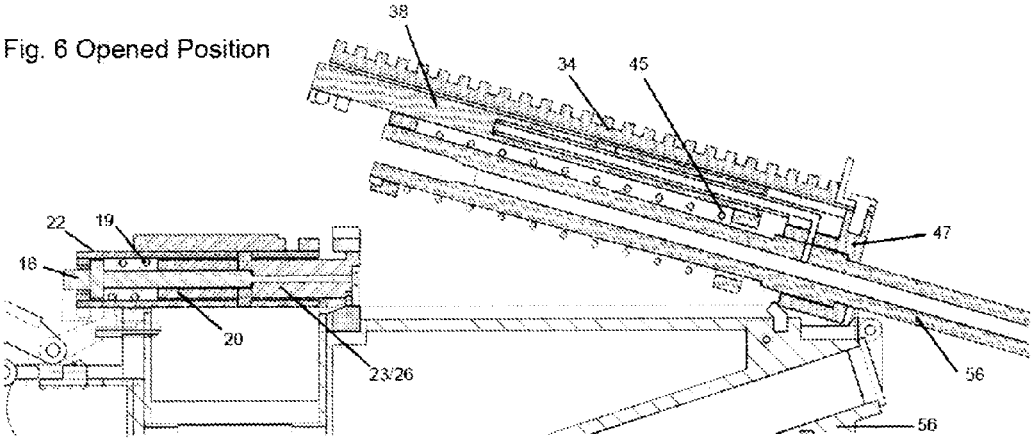
Fig. 7 Remove and Replace Barrel
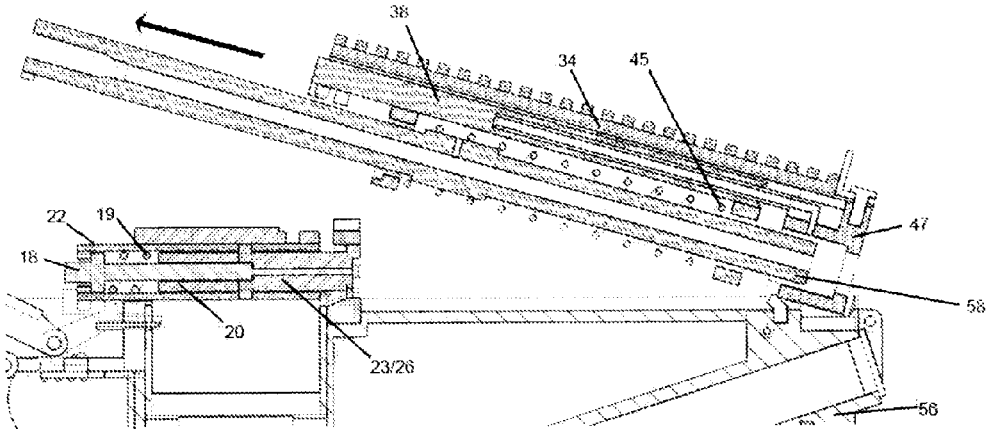

Fig. 8 Static Position
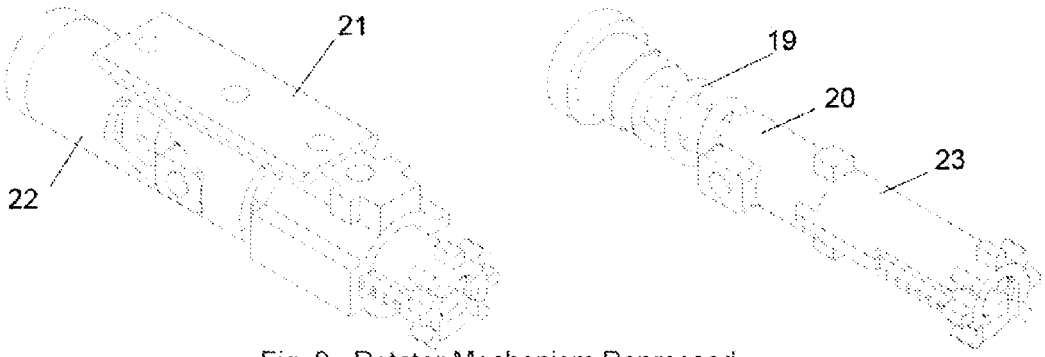
Fig. 9 Rotator Mechanism Depressed
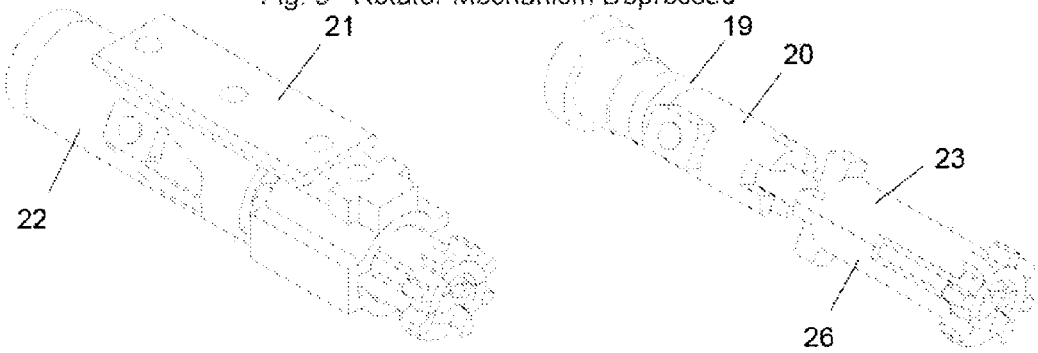
Fig. 10 Extractor Claw Mechanism
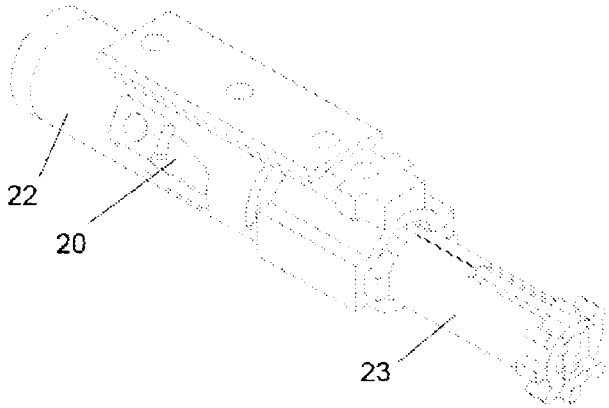

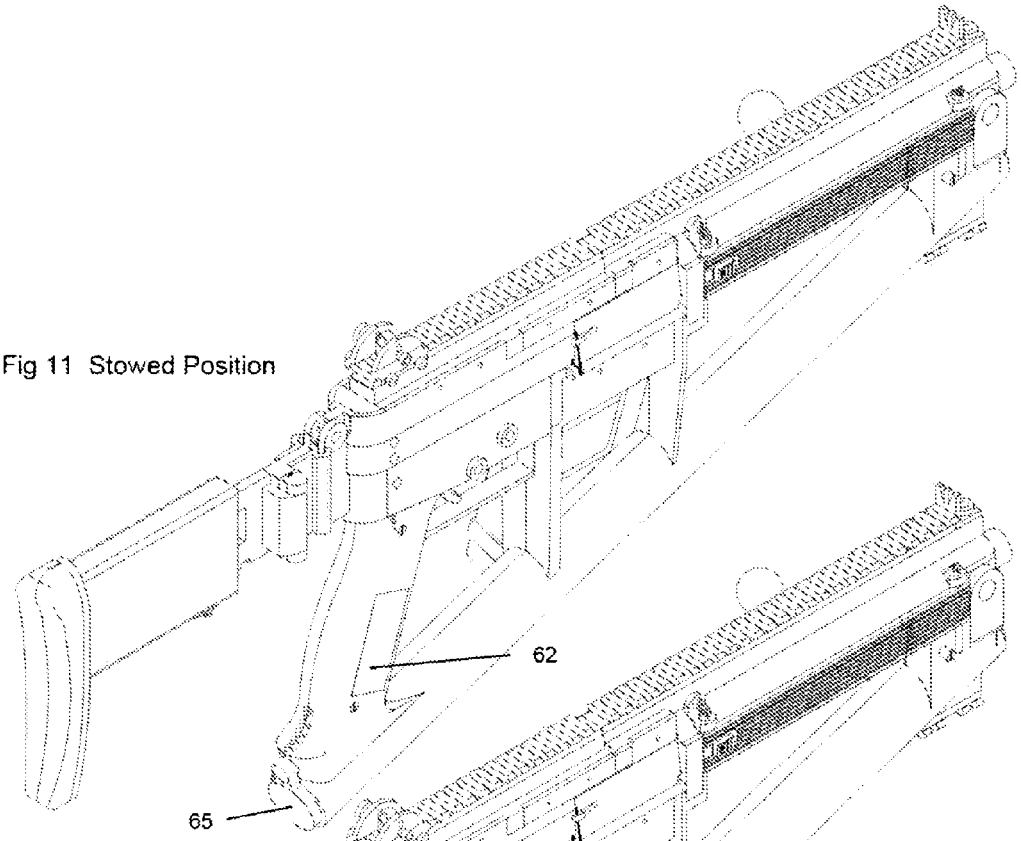
Fig 11 Stowed Position
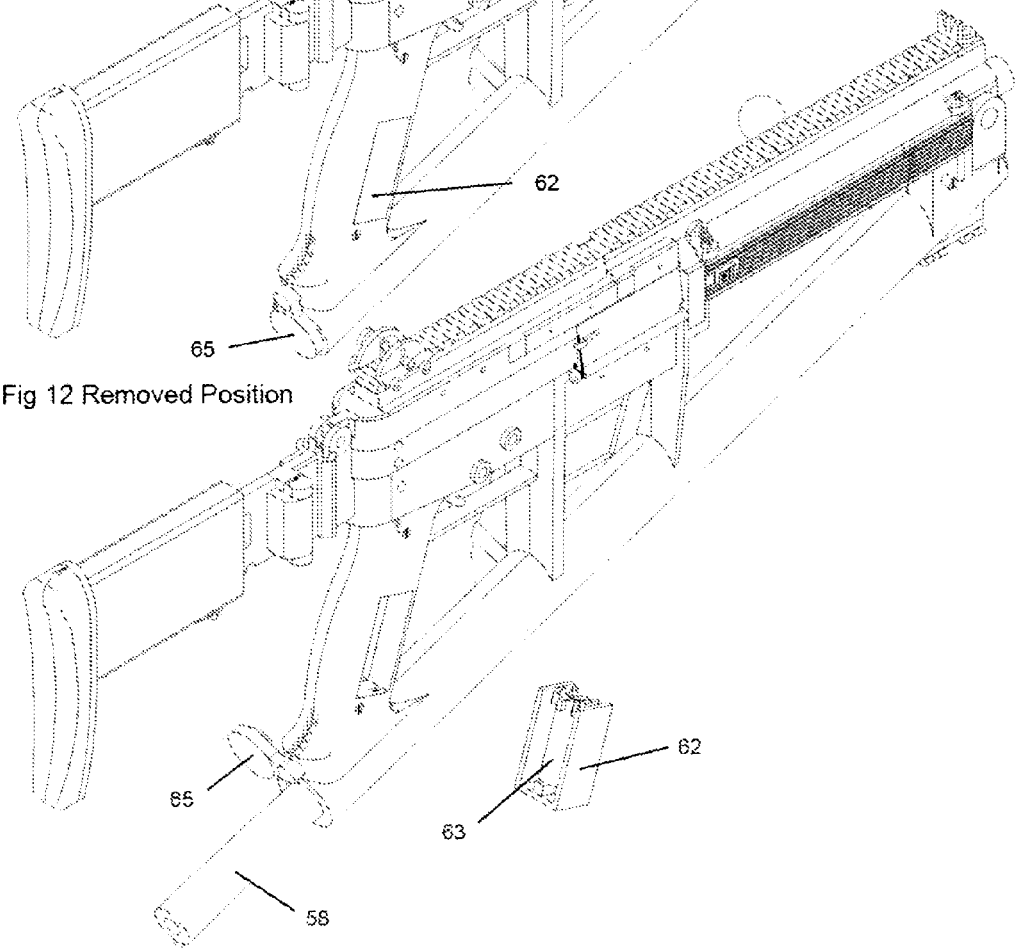
Fig 12 Removed Position

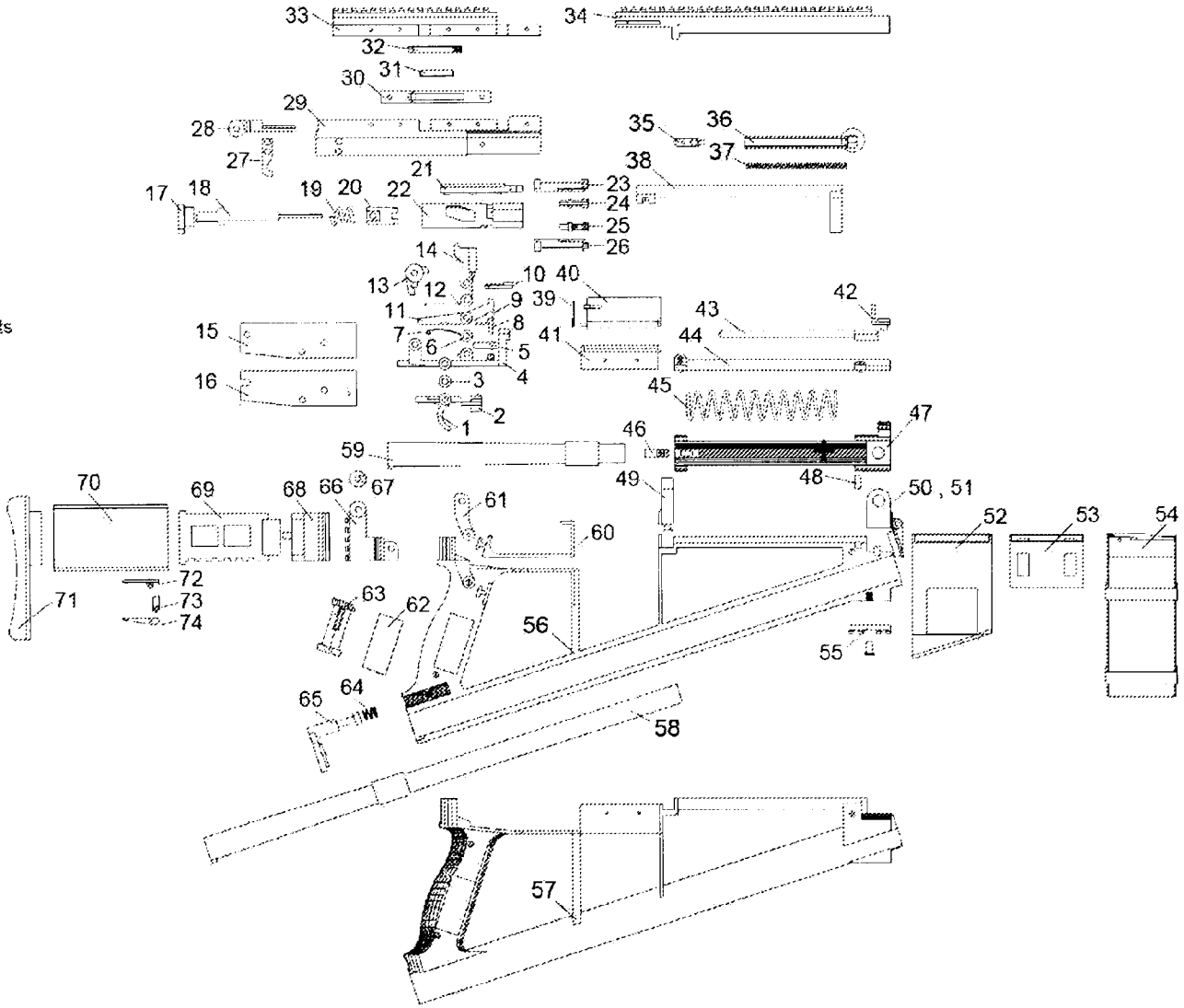
Fig. 13 - Diagram of Parts

Fig. 14 - Long Barrel with Butt Stock
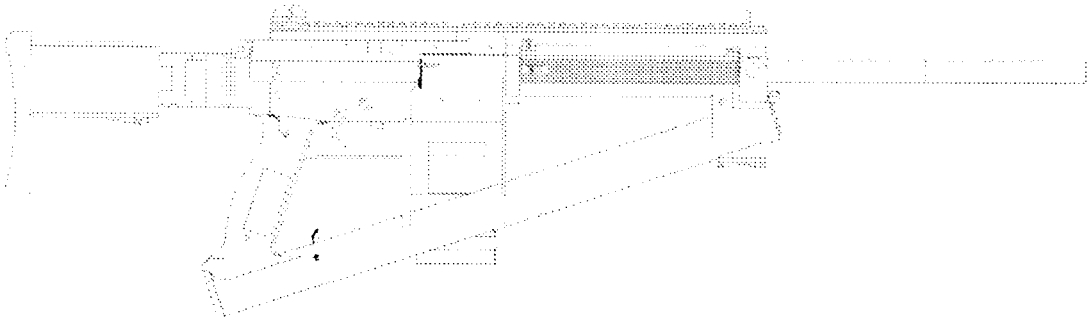
Fig. 15 - Short Barrel no Butt Stock
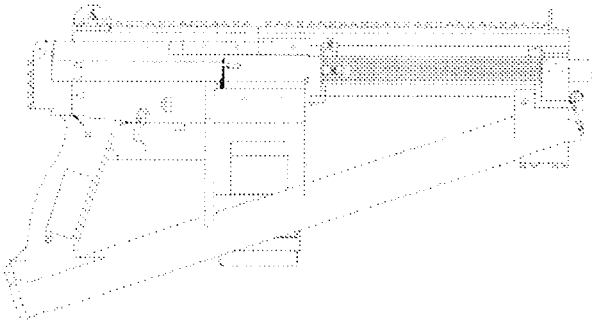
Fig. 16 - Short Barrel no Butt Stock Axon
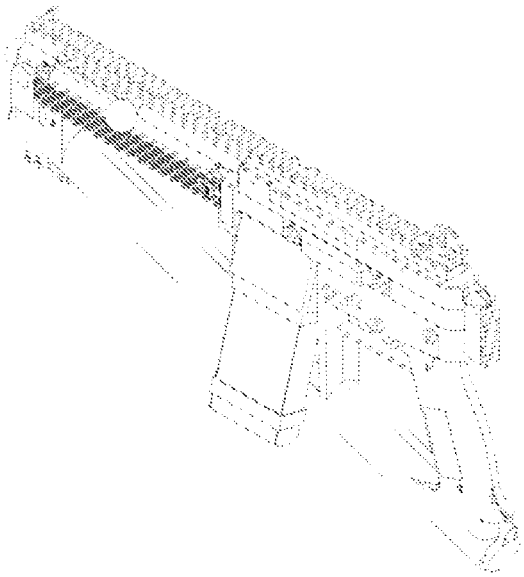

MULTI-CALIBER INTERCHANGEABLE RIFLE BOLT SYSTEM

DESCRIPTION OF DRAWINGS

Drawing A001—Ejector and Extractor Mechanism (Plan Section)
FIG. 1—Bolt Full Back Position
FIG. 2—Bolt Full Forward Position
Drawing A002—Ejector and Extractor Mechanism—Prior Art (Elevation)
FIG. 3—Prior Art
FIG. 4—Double Extractor
Drawing B001—Section of Barrel Reconfiguration (Elevation Section)
FIG. 5—Operational Position
FIG. 6—Open Position
FIG. 7—Remove and Replace Barrel
Drawing C001—Bolt Reconfiguration (Axon)
FIG. 8—Static Position
FIG. 9—Rotator Mechanism Depressed
FIG. 10—Extractor Claw Mechanism
Drawing D001—Stock Storage (Axon)
FIG. 11—Stowed Position
FIG. 12—Removed Position
Drawing M001—Diagram of Parts (Exploded Elevation)
FIG. 13—Diagram of Parts
Drawing F001—Examples of Preferred Embodiment
FIG. 14—Long Barrel and Butt Stock (Elevation)
FIG. 15—Short Barrel no Butt Stock (Elevation)
FIG. 16—Short Barrel no Butt Stock (Axon)

BACKGROUND OF INVENTION

General Purpose

The purpose for this gun design arises from the varied battlefields and combat scenarios faced by US combat forces throughout the world. This automatic machine gun is designed with the ability to quickly and without the use of tools switch barrels and bolts allowing the warfighter to quickly reconfigure their weapon in the field of battle. Also as part of this design the components used to reconfigure the weapon are stored within compartments which are integrated into the stock of the weapon. As an integrated weapons system this design integrates all of the standard machine gun design elements necessary to provide accurate and sustained automatic fire as well as add the benefits of quick reconfiguration to barrels of different length as well as barrels and bolts of three different common military calibers. Furthermore, the convenient storage of the components used for reconfiguration on the weapon itself makes this design a self contained weapons system.

SUMMARY OF INVENTION

This weapon is designed to be reconfigured to handle three common military calibers 0.308, 0.223/5.56X45, and 7.62X39. The weapon carries one bolt in the operational position and one auxiliary Extractor Claw Mechanism (23/24/25/26) in the storage position.

The weapon also carries one barrel in the operation position and one auxiliary barrel in the storage position. The weapon can deploy and store a barrel between 10" and 21" This capability allows the warfighter to effectively configure the weapon for engaging the enemy at long range as well as in close quarters. This represents a significant advantage over other modular weapons which can be reconfigured. The elements used to reconfigure other modular weapons must be carried separately from the weapon and require the use of tools to replace.

The bolt of this weapon can be quickly reconfigured to handle different caliber ammunition by replacing the portion of the bolt containing the extractor mechanisms without replacing the entire operational bolt of the weapon.

The multiple extractor system gives 120 degrees of extracting coverage (FIG. A4) at the base of the shell casing verses less than 50 degrees on a modern AR style rifle (FIG. A3). This innovation is achievable because one extractor also acts as the ejector. When the bolt travels backward an ejector ram hits a lug on the outside of the extractor. During this action the Right Extractor (24) holds the right lip of the casing while the Left Extractor (25) moves forward. A second lug on the inside of the Left Extractor (25) strikes the back of the casing forcing the cartridge out of the weapon.

DESCRIPTION OF PREFERRED EMBODIMENT

Description

The design is composed of a three part stock comprised of a Left Stock (55) Right Stock (56) and Magazine Stock Bracket (52). The main components which are attached to the stock include the Left Barrel Housing Hinge (50), Right Barrel Housing Hinge (51), Magazine Receiver (53), Receiver Block (49), Master Connector Bracket (61) and Butt Stock Mount (66).

The Barrel Housing Closure (44), Bolt Pull Rod Cover (34), Gas Piston (43), Front Sight (42), Charging Handle Retainer (35) Charging Handle Spring (37), Charging Handle (36) all attach to the Barrel Housing (47) while the Main Spring (45), and the Bolt Pull Rod (38), go inside The Barrel Housing (47). This assembly attaches to the Barrel Housing Hinges (50,51). The Barrel (58 or 59) is inserted into the Barrel Housing and the Barrel Housing Latch (46) engages the receiver block to hold the Barrel Housing in place.

The Trigger Assembly is comprised of the Trigger Group Bracket (4), Trigger (1), Safety (2), Trigger Bolt (3), Magazine Release (5), Hammer Bolt (6), Secondary Firing Spring (7), Magazine Release Pin (8), Magazine Catch Spring (9), Magazine Catch (10), Secondary Firing Mechanism (11), Hammer Spring (12), Hammer Arrestor (13), Hammer (14), Left Trigger Group Plate (15), Right Trigger Group Plate (16). The Trigger Group Assembly is attached to the stock with a pin though the Master Connector Bracket (61).

The Bolt is comprised of the Bolt Slide (21) which is screwed to the Bolt Body (22). The Rotator Mechanism is inserted into the bolt body as well as the Firing Pin Spring (19) and the Firing Pin (18) all of which is held in place by the Bolt Closure (17). The Extractor Claw Mechanism is comprised of the Upper Extractor Claw Body (23), Lower Extractor Claw Body (26), Right Extractor Claw (24), Left Extractor Claw (25). The Extractor Claw Mechanism is inserted into Bolt.

The Upper is comprised chiefly of the Bolt Housing Upper (29) and the Bolt Housing Pull Rod Cover (33). Attached to these pieces are Extractor Ram Housing (30), Extractor Ram Spring (31), and Extractor Ram (32). This assembly is attached to the weapon by a pin though the Bolt Housing Upper Hinge (28) into the Butt Stock Mount (66). The bolt is inserted into the slid rail of the Bolt Housing Pull Rod Cover (33). The Upper is held in place when the Barrel Housing assembly is locked into position.

Use

Reconfiguration:

One of the chief innovations of this design is the weapons ability to quickly change barrels and bolts without the use of tools. The Barrel (58 or 59) is replaced by sliding the Barrel Housing Latch (46) on the side of the Barrel Housing (47) forward. The Barrel Housing (47) is secured to the Stock (56/57) by the Bolt Housing Hinge (50/51) at the very end of the forestock. Once the Barrel Housing Latch (46) is slid forward the Barrel Housing (47) rotates upward on the Bolt Housing Hinge (50/51) allowing the barrel to be removed backwards out Barrel Housing (47).

The desired replacement barreled can then be inserted into the Barrel Housing (47) through the Main Spring (45) and through the yoke of the Bolt Pull Rod (38). (FIG. B2) The Barrel Housing (47) is then rotated into the operational position (FIG. B1) locking the barrel into the weapon. A lug near the breech of the barrel assures proper alignment of the barrel. I rubber peg near the hinge tensions the barrel tight to the stock increasing accuracy. The Barrel Housing Latch (46) secures the Barrel Housing (47) into position for operation. This simple system for barrel replacement makes a quick reconfiguration of the weapon to handle barrels of different lengths and caliber possible.

The bolt is reconfigured by removing the portion of the bolt containing the Extractor Claw Mechanism (23/24/25/26) from the Bolt Body (22) This is done by first opening the Barrel Housing (47). The Master Assembly Pin (67) is then rotated 90 degrees and removed partially allowing the Bolt Housing Upper (29) to rotate rearward. The bolt can then be slid forward out of the Bolt Pull Rod Cover (33) which is affixed to the Bolt Housing Upper (29). To reconfigure the bolt the Rotator Mechanism (20) is rotated counterclockwise until fully depressed. This allows the Extractor Claw Mechanism (23/24/25/26) to be rotated clockwise aligning the retaining lugs with slots in the main bolt. This allows the Extractor Claw Mechanism (23/24/25/26) to be slid forward and removed from the Bolt Body (22).

With the Rotator Mechanism (20) fully depressed the desired Extractor Claw Mechanism (23/24/25/26) can then be inserted into the Bolt Body (22). Once the Rotator Mechanism (20) is released the Extractor Claw Mechanism (23/24/25/26) will be locked into the bolt.

This weapon also features a Main Spring (45) which is forward of the bolt and surrounding the barrel. This feature is designed to decreases muzzle rise and makes the overall weapon shorter by eliminating a spring behind the bolt. This spring pushes against the breech driving the Bolt Pull Rod (38) forward pulling the bolt into the breech and engaging the locking bolt locking lugs into the breech.

This design also features an automatically releasing magazine. When the magazine is empty a spring within the magazine follower pushes a stud through the magazine catch hole pushing the magazine catch out of the magazine and releasing the magazine to fall free of the weapon.

Bolt Slam Automatic Action:

The automatic fire capability of this weapon is achieved by utilizing the forward motion of the bolt to release the hammer. The first shot is fired by pulling the Trigger (1) rearward. This releases the Hammer Arrestor (13) thus releasing the Hammer (14) to strike the Firing Pin (18). As the Hammer (14) strikes the Firing Pin (18) the cartridge is discharged. High pressure gas exits through a hole in the barrel and is released into the Bolt Pull Rod (38). This forces the Bolt Pull Rod (38) and equally the bolt rearwards. As the bolt travels rearward the Hammer (14) is forced down engaging the Hammer Arrestor (13). As the bolt slides forward the hammer tensions the Hammer Arrestor (13) which is stopped in position by the Secondary Firing Mechanism (11). As the bolt travels forward it trips the Secondary Firing Mechanism (11) which releases the Hammer Arrestor (13) which in turn releases the Hammer (14) starting the firing cycle over again.

Double Extractor Claw:

The Extractor Claw Mechanism (FIG. A1 and A2) of this weapon features a Left Extractor Claw (25) and Right Extractor Claw (24). This provides a positive extraction of the empty cartridge from the barrel chamber. (FIG. A1) The Right Extractor Claw (24) is stationary while the Left Extractor Claw (25) moves forward when engaged by the Extractor Ram (32) upon cocking the bolt into the fully rearward position or in firing when the Bolt Pull Rod (38) moves the bolt fully rearward.

Reconfiguration Unit Storage:

The ability of this gun to store an extra Extractor Claw Mechanism (23/24/25/26) and Barrel (58/59) within the weapon itself is a significant battlefield advantage. The Barrel (58/59) is stored in a tube which is an integrated part of the Stock (56/57). A spring loaded Barrel Tube Lid (65) at the lower end of tube retains the barrel within the tube. The extra Extractor Claw Mechanism (23/24/25/26) is stored in the Extractor Claw Dock (62) which slides into handle of the weapon. The Extractor Claw Dock (62) is slid out the side of the handle to access the Extractor Claw Mechanism (23/24/25/26).

Manufacturing

1. The stock is injection molded from Impact Resistant ABS plastic. The stock is composed of a Left Stock (56), a Right Stock (57), and a Magazine Stock Bracket (52) These pieces are assembled using standard screws and ferrules. The Bolt Housing Closure (44), Extractor Claw Dock (62), Butt Stock (70), and Butt Stock Pad (71) are also constructed of Impact Resistant ABS plastic.

2. All Barrels (58/59) are constructed of lathed stainless steel

3. Bolt Pull Rod Cover (34) and Bolt Housing Pull Rod Cover (33) are cast from steel and milled to reach final finished state.

4. All bolt elements include Rotator Mechanism (20) Bolt Body (22) Firing Pin (18) Bolt Closure (17) Extractor Claw Mechanism (23/24/25/26) are constructed of milled stainless steel. The Bolt Closure screws into the back of the Bolt Body retaining the Bolt Spring (19) Rotator Mechanism (20) and Firing Pin (18) within the Bolt Body (22) The Extractor Claw Mechanism is constructed by placing the lugs of the Right Extractor Claw (24) and the Left Extractor Claw (25) into the slots on the Extractor Claw Lower (26). The Extractor Claw Upper (23) is then placed on top and the edges of the Extractor Claw Upper (23) and Extractor Claw Lower (26) are welded together.

5. All other metallic pieces including Trigger (1), Safety (2), Trigger Bolt (3), Trigger Group Bracket (4), Magazine Release (5), Hammer Bolt (6), Magazine Release Pin (8), Magazine Catch (10), Secondary Firing Mechanism (11), Hammer Arrestor (13), Hammer (14), Left Trigger Group Plate (15), Right Trigger Group Plate (16), Bolt Housing Upper Latch (27), Bolt Housing Upper Hinge (28), Ejector Ram Housing (30), Ejector Ram (32), Charging Handle Retainer (35), Charging Handle (36), Bolt Pull Rod (38), Receiver Cover (40), Receiver Cover Bracket (41), Front Sight (42), Gas Piston (43), Barrel Housing Latch (46), Barrel Housing (47), Receiver Block (49), Left Barrel Housing Hinge (50), Right Barrel Housing Hinge (51), Trigger Guard (60) Master Connector Bracket (61), Barrel Tube Lid (64) Butt Stock Mount (66), Master Assembly Pin (67), Butt Stock Bracket (68), Butt Stock Arm (69), Catch Bracket (72), Catch (73), Catch Lever (74) are constructed of milled stainless steel. All metal elements are parkerized on faces not subject to abrasion and wear.

6. The Magazine Receiver (53) is stamped and formed from sheet steel. The Magazine (54) is constructed of punched sheet steel elements held together by punched sheet steel elements spot welded into position.

7. The Barrel Tensioning Block (48) is constructed of vulcanized rubber

8. All screws and ferrules are hardware store grade.

9. All operational springs are constructed of spring steel.

The invention claimed is:

1. A bolt carrier group which can be reconfigured to hold and fire cartridges of different calibers by means of replacing and/or otherwise modifying a portion of the bolt carrier group containing a mechanism for holding and/or extracting the cartridge, comprising:

a bolt carrier;

a rotating mechanism;

an interchangeable mechanism configured for holding and/or extracting the cartridge;

a firing pin;

and a firing pin spring that exerts a mechanical force on the rotating mechanism, wherein said rotating mechanism then applies a force against the interchangeable mechanism in order to retain the rotating mechanism and the interchangeable mechanism engaged with the bolt carrier.

2. A bolt carrier group according to claim 1, wherein the rotating mechanism functions to cause rotation of the bolt, and also functions to retain or release the interchangeable mechanism.

3. A bolt carrier group according to claim 1, wherein the rotating mechanism comprises a female portion that interlocks with a male portion of the interchangeable mechanism, and wherein the rotating mechanism and interchangeable mechanism are separable without the use of any tools.

* * * * *